US005936217A

United States Patent [19]

Takahashi et al.

[11] Patent Number: 5,936,217

[45] Date of Patent: Aug. 10, 1999

[54] SWITCHING APPARATUS AND ACTIVATION SUPPRESSION METHOD FOR ELECTRIC CONTACT

[75] Inventors: Katsuya Takahashi; Yukihiro Takahashi; Shigeyuki Mori; Kazushi Sugawara, all of Iwate, Japan

[73] Assignee: NEC Corporation, Tokyo, Japan

[21] Appl. No.: 08/972,891

[22] Filed: Nov. 18, 1997

[30] Foreign Application Priority Data

Nov. 18, 1996 [JP] Japan ..... 8-306743

[51] Int. Cl.[6] ..... H01H 33/06; H01H 33/60; H01H 9/32

[52] U.S. Cl. ..... 218/90; 218/155

[58] Field of Search ..... 335/151–154, 335/156; 218/10, 12, 13, 14, 89, 90, 91, 92, 155, 156, 158; 200/302.3–306

[56] References Cited

U.S. PATENT DOCUMENTS

| | | | |
|---|---|---|---|
| 2,231,576 | 2/1941 | Grosse | 218/90 |
| 2,377,866 | 6/1945 | D'Alelio | 218/90 |
| 3,222,489 | 12/1965 | Chaikin . | |
| 5,352,424 | 10/1994 | Howard et al. . | |
| 5,554,963 | 9/1996 | Johler et al. | 335/151 |

FOREIGN PATENT DOCUMENTS

| | | |
|---|---|---|
| 0061655 | 6/1982 | European Pat. Off. . |
| 63-80738 | 4/1988 | Japan . |
| 6-162859 | 6/1994 | Japan . |

*Primary Examiner*—Lincoln Donovan
*Attorney, Agent, or Firm*—Sughrue, Mion, Zinn, Macpeak & Seas, PLLC

[57] ABSTRACT

A switching apparatus wherein the life and the reliability of an electric contact are improved by fundamentally suppressing formation of black powder and activation of the surface of the contact by a chemical reaction. Microcapsules in which organic acid or organic acid precursor from which organic acid is produced as time passes is enclosed are placed into the internal space of an enclosed case so that organic compounds produced on and in the proximity of contact surfaces is oxidized with organic acid which escapes from the microcapsules and vaporized in the enclosed case without forming a film on the surfaces of the contacts to suppress activation of the surfaces of the contacts.

17 Claims, 5 Drawing Sheets

SWITCHING APPARATUS AND ACTIVATION SUPPRESSION METHOD FOR ELECTRIC CONTACT

BACKGROUND OF THE INVENTION

1. Field of the Invention

This invention relates to improvements in or relating to an electric contact accommodated in an enclosed case of a switching apparatus, and more particularly to a switching apparatus which includes an electric contact from which a harmful component which brings about a contacting problem of the contact may possibly be produced and a method of suppressing activation of an electric contact of the switching apparatus of the type mentioned.

2. Description of the Related Art

In an electric switching apparatus such as a relay or a switch wherein electric contacts are accommodated in an enclosed case, if organic compounds are generated in the enclosed case, then this forms black nonconductor called black powder which brings about a contacting problem of the contacts and the contacts are activated in which arc discharge is likely to occur therebetween as a result of chemical reaction of organic compounds. Therefore, formation of black powder makes a serious problem particularly with a miniature relay for communication and like apparatus.

Several countermeasures for preventing an injurious effect by black powder are known and disclosed, for example, in the following documents.

① Japanese Patent Laid-Open Application No. Heisei 6-162859

From the point of view that organic gas is attracted to the surfaces of contacts and carbonized to form black powder, which increases the contact resistance, in order to prevent such attraction and carbonization of organic gases, a physical protective film of organic compounds having a comparatively low vapor pressure such as polyhydric alcohol is positively formed on the surfaces of the contacts. The protective film exhibit additional physical actions of attraction of corrosive gas and suppression of abrasion of the surfaces of the contacts.

② Japanese Patent Laid-Open Application No. Showa 63-80738

Electric contacts built in and used with a small motor or the like are placed in an ether and alcohol atmosphere in a case so as to form, on the contacts, a film which provides lubricity to the surfaces of the contacts to reduce the contact resistance between and prevent abrasion of the contacts.

However, the conventional techniques described above have the following problems.

The first provides resides in that, where the contact load is low, the contact resistance is unstable, which gives rise to a new problem that the contacting stability is lost. The reason is that both of the conventional techniques are intended, in order to suppress production of black powder and increase in contact resistance, to physically prevent attraction of organic gases to the surfaces of contacts by attracting organic compounds containing oxygen to the surfaces of the contacts to artificially form an organic film on the surface of the contacts (organic compounds containing oxygen are used by a large amount so that the organic compounds containing oxygen may form an organic film of a sufficient thickness on the surfaces of the contacts).

The second problem resides in that it is difficult to continue to prevent attraction of organic gases to the surfaces of contacts for a long period of time. The reason is that, since organic gas itself which may possibly make black powder is not reduced, the density of the organic gases increase as time passes.

The third problem resides in that, once a contact becomes activated, the deteriorating tendency of production of black powder cannot be suppressed any more. The reason is that attraction of organic gas to the surfaces of contacts is merely prevented physically by an organic film and the reaction itself of the surfaces of the contacts is not controlled.

By the way, chemical reactions on the surface of a contact are roughly divided into the following two reactions.

The first reaction is a reaction when contacts are opened and closed, in which black powder produced by a chemical reaction caused by arc discharge which occurs between the contact. Arc is enhanced by the presence of black powder and accelerates the formation of black powder, which result in the increase in contact resistance.

The second reaction is a reaction when no current flows between contacts, in which the surfaces of the contacts are put into a chemically active condition by friction upon opening and closing of the contacts or exposure of fresh surfaces of the contact materials and conversion of organic compounds, which is present in a case of the apparatus, into black powder is accelerated by a tribochemical reaction originating from a chemical activity of the surfaces of the contacts.

SUMMARY OF THE INVENTION

It is an object of the present invention to provide a switching apparatus wherein contacts are longer in life than ever and are improved in reliability and an activation suppression method for electric contacts of a switching apparatus.

In order to achieve the object described above, the present invention adopts not the idea that the surfaces of contacts are physically coated to protect the surfaces of the contacts from black powder, but the idea that formation itself of black powder and activation itself of the surfaces of the contacts are suppressed fundamentally by a chemical reaction.

In particular, according to an aspect of the present invention, there is provided a switching apparatus, comprising an enclosed case, an electric contact accommodated in said enclosed case, and microcapsules placed in an internal space of said enclosed case and having filled therein organic acid or organic acid precursor from which organic acid is formed as time passes in such a manner as to reach a condition wherein the organic acid which escapes from said microcapsules and floats in said enclosed case oxidizes organic compounds which are produced on and in the proximity of a surface of said contact without forming a film on the surface of said contact so that activation of the surface of said contact can be suppressed.

According to another aspect of the present invention, there is provided a switching apparatus, comprising an enclosed case, an electric contact accommodated in said enclosed case, and organic acid or organic acid precursor from which organic acid is formed as time passes, said organic acid or organic acid precursor being held for evaporation on said enclosed case or internal parts of said enclosed case other than said electric parts in such a manner as to reach a condition wherein the organic acid which escapes from said enclosed case or internal part and floats in said enclosed case oxidizes organic compounds which are produced on and in the proximity of a surface of said contact without forming a film on the surface of said contact so that activation of the surface of said contact can be suppressed.

According to a further aspect of the present invention, there is provided a switching apparatus, comprising an enclosed case, an electric contact accommodated in said enclosed case, and organic acid or organic acid precursor from which organic acid is formed as time passes, said organic acid or organic acid precursor being filled in said enclosed case in such a manner as to reach a condition wherein the organic acid which floats in said enclosed case oxidizes organic compounds which are produced on and in the proximity of a surface of said contact without forming a film on the surface of said contact so that activation of the surface of said contact can be suppressed.

According to a still further aspect of the present invention, there is provided a method of suppressing activation of an electric contact accommodated in an enclosed case of a switching apparatus, comprising the step of placing microcapsules in which organic acid or organic acid precursor from which organic acid is formed as time passes is filled into an internal space of said enclosed case such that organic compounds which are produced on and in the proximity of a surface of said contact is oxidized by the organic acid which escapes from said microcapsules and floats in said enclosed case without forming a film on the surface of said contact to suppress activation of the surface of said contact.

According to a yet further aspect of the present invention, there is provided a method of suppressing activation of an electric contact accommodated in an enclosed case of a switching apparatus, comprising the step of holding organic acid or organic acid precursor from which organic acid is formed as time passes for evaporation on said enclosed case or internal parts of said enclosed case other than said electric contact such that organic compounds which are produced on and in the proximity of a surface of said contact is oxidized by the organic acid which escapes from the held condition and floats in said enclosed case without forming a film on the surface of said contact to suppress activation of the surface of said contact.

According to a yet further aspect of the present invention, there is provided a method of suppressing activation of an electric contact accommodated in an enclosed case of a switching apparatus, comprising the step of filling organic acid or organic acid precursor from which organic acid is formed as time passes in said enclosed case such that organic compounds which are produced on and in the proximity of a surface of said contact is oxidized by the organic acid which floats in said enclosed case without forming a film on the surface of said contact to suppress activation of the surface of said contact.

In the switching apparatus and the activation suppression methods, since organic compounds from which black powder may be formed or organic compounds which are changing to black powder is oxidized in a condition that organic acid which floats as gas in the enclosed case does not form a film on the surface of the contact, formation of black powder on and in the proximity of the surface of the contact can be prevented thereby to suppress activation of the surface of the contact. Accordingly, increase in life of the electric contact and remarkable improvement in reliability of the switching apparatus can be realized without taking the risk that a new problem arises by artificial formation of an organic film on the surface of a contact as in the prior art.

As the organic acid or organic acid precursor, organic acid having a carboxyl group or precursor of organic acid having a carboxyl group may be used, and preferably, formic acid or formic acid precursor is used. Where oxygen is filled in the enclosed case, an oxidation by the organic acid can be accelerated, and where the electric contact contains silver, the oxidation by the organic acid upon the organic compounds can be promoted by a catalytic action of the silver.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
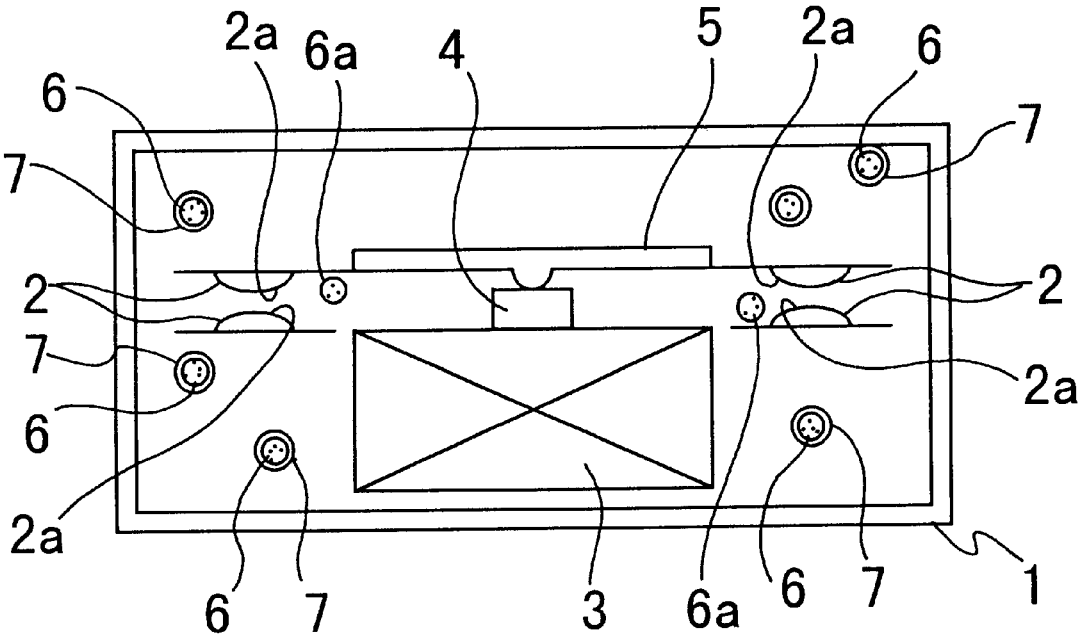
FIG. 1 is a schematic sectional view of a switching apparatus to which the present invention is applied.
Figure 2:
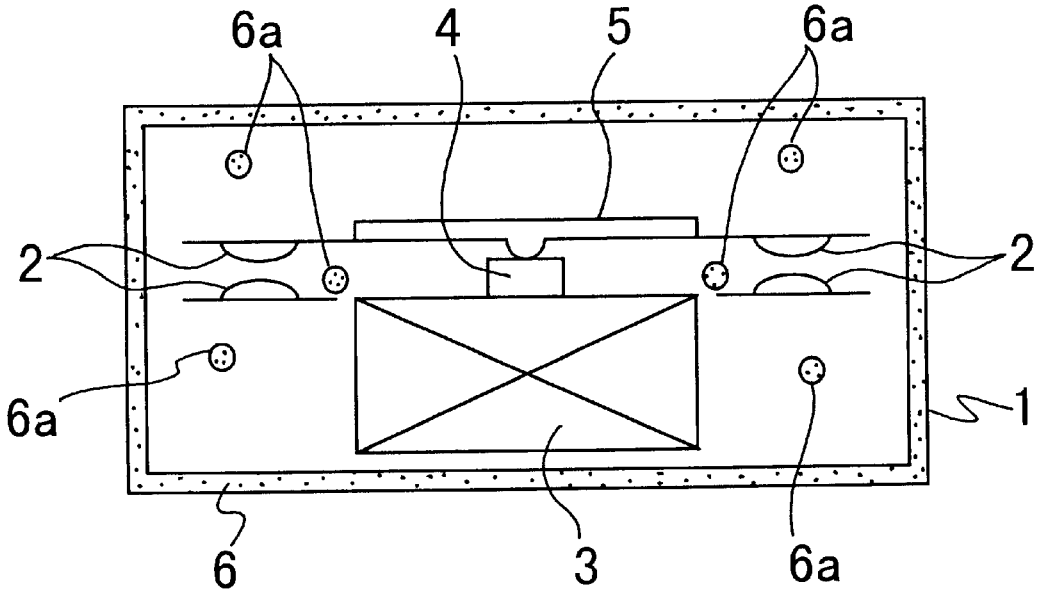
FIG. 2 is a schematic sectional view of another switching apparatus to which the present invention is applied.
Figure 3:
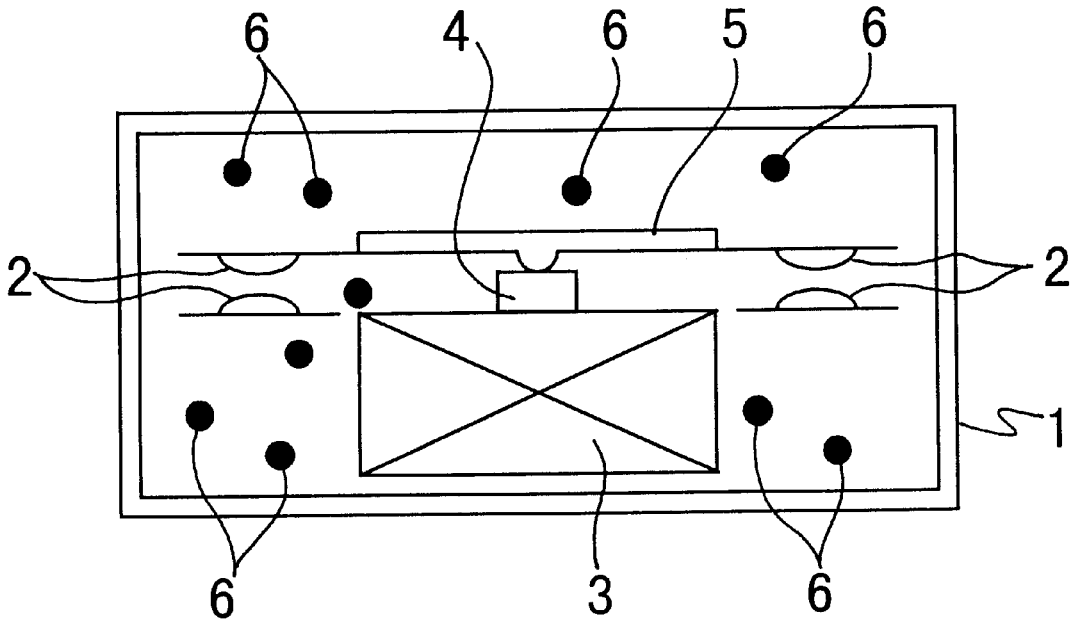
FIG. 3 is a schematic sectional view of a further switching apparatus to which the present invention is applied.

FIGS. 1, 2 and 3 are schematic sectional views showing different switching apparatus to which the present invention is applied. The switching apparatus are each formed as a relay and are common in construction in that relay components such as electric contacts 2, an electromagnet 3, a permanent magnet 4 and an armature 5 are accommodated in an enclosed case 1.

Referring first to FIG. 1, the switching apparatus shown is constructed such that a large number of microcapsules 7 in which organic acid or organic acid precursor 6 from which organic acid is produced as time passes is enclosed are placed in the internal space of the enclosed case 1 to reach a condition wherein organic acid 6*a* when it escapes from the filled state by the microcapsules 7 and vaporizes in the enclosed case 1 oxidizes organic compounds produced on and in the proximity of the contact surfaces 2*a* without forming a film on the contact surfaces 2*a*. This condition can be realized readily by using an organic acid that have high vapor pressure and a precursor of organic acid as the organic acid or organic acid precursor 6 and adjusting the physical properties, the volumes, the quantity, the filling method and/or the filling locations of the microcapsules 7 so that the organic acid 6*a* which may escape from the microcapsules 7 and float in the internal space of the enclosed case 1 may not become so surplus as to form an organic film on the contact surfaces 2*a*.

Even if the organic acid or organic acid precursor 6 is filled in the microcapsules 7, the filling is not performed in such a form that the airtight filling state is maintained permanently but in such a form that, after the microcapsules 7 are placed into the internal space of the enclosed case 1, the organic acid or organic acid precursor 6 escapes from the filled state by a physical or chemical change, for example, in such a form that the microcapsules 7 are broken by thermal expansion of the filled organic acid or organic acid precursor 6 or the microcapsules 7 are melted by heat. Meanwhile, the organic acid or organic acid precursor 6 may be filled into the microcapsules 7, for example, by a method wherein organic acid or organic acid precursor is emulsified in solution so that it is dispersed as fine particles into the solution and then an organic compound is added to form a solid thin film on outer hulls of the fine particles of the organic acid or organic acid precursor, or by some other suitable method.

While various organic compounds are present in the enclosed case 1, as organic compounds from which black powder is formed, aromatic compounds including toluene are listed. While such organic compounds are changed to black powder as a result of such two reactions as described above on the surfaces of the contacts, such change is suppressed, in the first embodiment of FIG. 1, by the following action.

Figure 4:
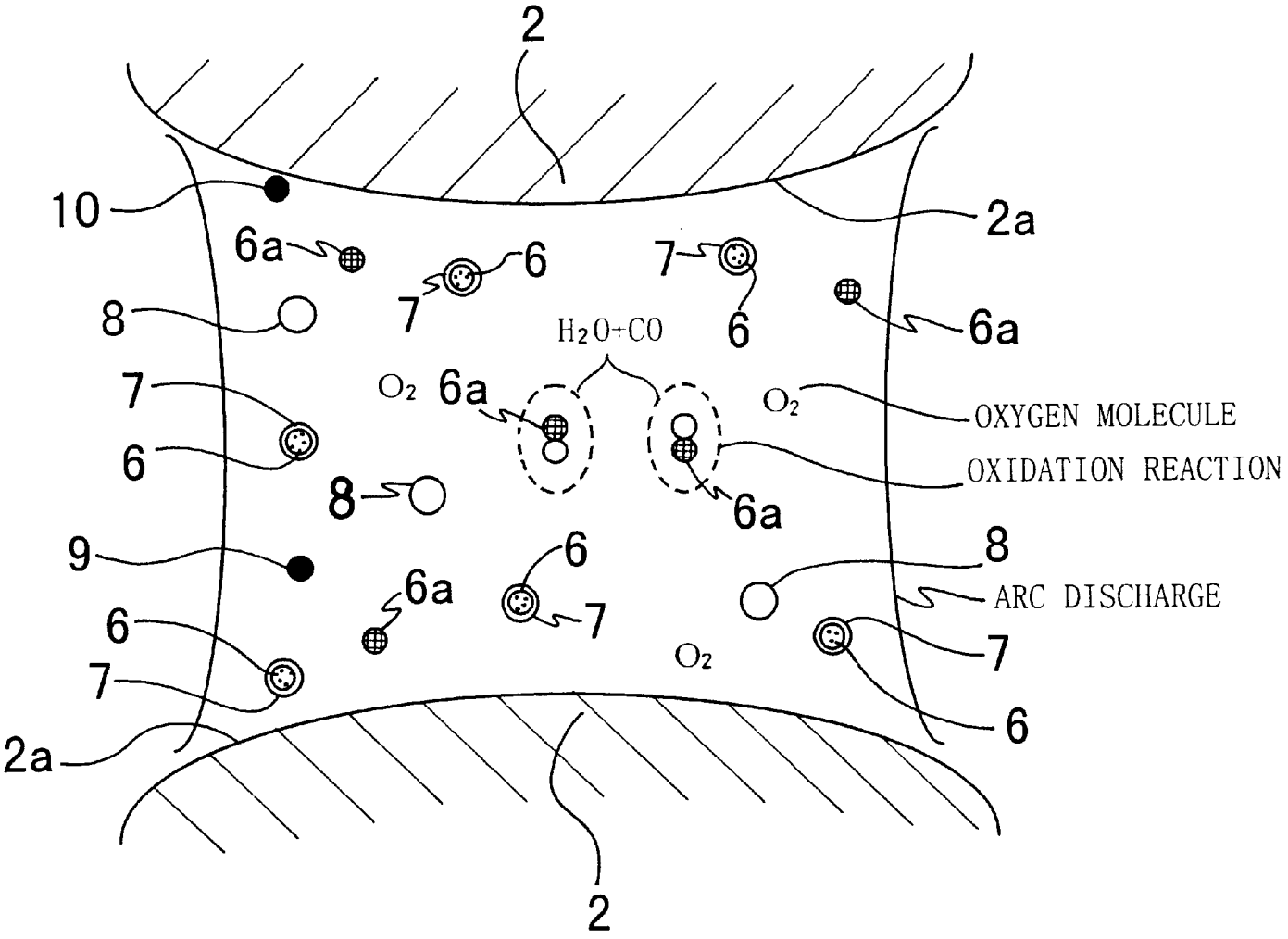
FIG. 4 is a schematic view illustrating of action of the switching apparatus of FIG. 1.

Referring to FIG. 4, organic compounds 8 from which black power may be formed is oxidized by the organic acid 6*a*, which has escaped from the microcapsules 7 and floats, so that $H_2O$ and $CO_x$ (x=1, 2), which are inorganic molecules, are formed. Meanwhile, also organic compounds 9 which is changing to black powder, which makes a cause of activation of the contact surfaces 2*a* or a problem to contacting of the contacts, is oxidized by the vaporized organic acid or organic acid precursor 6 to form $H_2O$ and $CO_x$, which are inorganic molecules. Accordingly, conversion on and in the proximity of the contact surfaces 2*a* into black powder can be prevented to suppress activation of the contact surfaces 2*a*. Since the organic acid or organic acid precursor 6 is filled in the microcapsules 7 and such an oxidation as described above is performed only by the organic acid 6*a* which escapes from the filled condition and floats, such a situation that surplus organic acid is attracted to the contact surfaces 2*a* to form an organic film does not occur, and it can be suppressed to the utmost that components in the enclosed case 1 are corroded by organic acid. It is to be noted that reference numeral 10 in FIG. 4 denotes black powder.

For the organic acid, from the reason that new organic compound is not produced as a by-product of such an oxidation as described above, it is preferable that the ratio of the number of oxygen atoms in a molecule to the number of organic molecule carbon atoms is as high as possible, and where the material of the contacts contains silver, from the reason that a multiple effect by a catalytic action of the silver in an oxidation is obtained, it is preferable that the organic acid has a carboxyl group (COOH). Formic acid has the strangest effect. Since formic acid is small in molecular weight and is high in ratio of a carboxyl group occupying in the molecular weight, it is an organic acid which has a larger oxygen content per weight than other organic acids. Accordingly, it is suitable to cause such oxidation reactions as described above to occur. Further, for the organic acid precursor, acetates, propionic esters, formates and so forth may be used in addition to formic acid esters.

Referring now to FIG. 2, the switching apparatus shown is constructed such that organic acid or organic acid precursor 6 from which organic acid is produced as time passes is held for evaporation on the enclosed case 1 to establish a condition wherein organic acid 6*a* when it escapes from its held state and floats as gas oxidizes organic compounds produced on and in the proximity of contact surfaces 2*a* without forming a film on the contact surfaces 2*a*. The oxidation in it is similar to that described above. As means for holding the organic acid or organic acid precursor 6 for evaporation on the enclosed case 1, a method wherein organic acid or organic acid precursor is attracted or applied to or else impregnated in the inner face of the enclosed case 1, or another method wherein organic acid or organic acid precursor is blended in a material of the enclosed case 1. Since such internal components as described above are accommodated in addition to the electric contacts 2 in the enclosed case 1, the organic acid or organic acid precursor may be held for evaporation on any of the internal components. While the switching apparatus of the second embodiment is somewhat inferior in controllability in production of organic acid to the switching apparatus of the first embodiment, the duration of the suppressing effect of the electric contact activation can be raised comparatively readily.

Referring now to FIG. 3, the switching apparatus shown is constructed such that organic acid or organic acid precursor 6 from which organic acid is produced as time passes is filled as gas in the internal space of the enclosed case 1 to reach a condition wherein the vaporized organic acid 6*a* oxidizes organic compounds produced on and in the proximity of the contact surfaces 2*a* without forming a film on the contact surfaces 2*a*. The oxidizing reaction of it is similar to those described above.

In any of the switching apparatus of the first, second and third embodiments described above, one of organic acid and organic acid precursor may be used or both of them may be used. Further, if gases in which oxygen (including the air) of a suitable concentration is mixed is filled, for example, upon replacement of gases in the enclosed case 1, then oxidation by organic acid can be promoted by an increase of the amount of oxygen in the enclosed case 1. The filling of oxygen may be performed simultaneously with or separately from the filling of organic acid or organic acid precursor. When oxygen is filled simultaneously, it is a simple and convenient method to mix and fill them in advance.

Figure 5:
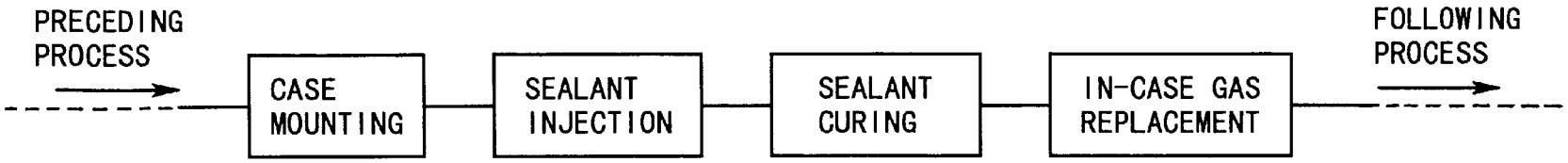
FIG. 5 is a flow diagram illustrating a procedure of manufacture of a switching apparatus.

Referring to FIG. 5, in manufacturing of relays, switches or a like apparatus to which a switching apparatus of the present invention wherein the electric contacts 2 and so forth are accommodated in the enclosed case 1 is applied, it usually undergoes adhesion of a case, injection of a sealant, curing of the sealant and replacement of gas in the case and is then transported to a following step after a vent hole provided for the replacement is closed up. However, in the case of the switching apparatus of FIG. 1, the microcapsules 7 are supplied in a preceding process, but in the case of the switching apparatus of FIG. 3, in the process of replacement of gas in the case, organic acid or organic acid precursor is filled into the enclosed case 1. Since, once the vent hole is closed up, organic acid or organic acid precursor cannot be supplied or replenished any more into the enclosed case 1 unless the enclosed case 1 is destroyed, if a measure which allows such supply or replenishment when necessary is provided for the enclosed case 1, then the durability of the electric contact activation suppressing effect can be raised.

<Experimental Examples>

For three relays (in each of which the inside of the enclosed case 1 was kept at the atmospheric pressure) including ① a relay wherein toluene of 5 Torr+nitrogen was filled ② another relay wherein toluene of 5 Torr+formic acid of 5 Torr+nitrogen was filled, and ③ a further relay wherein toluene of 5 Torr+formic acid of 5 Torr+air was filled in the enclosed case 1, a load of 15V (28Ω) was applied between the contacts to cause them to effect opening and closing operations while the degree of activation of the contacts, which was estimated on the basis of a rapid increase in arc energy, was monitored with the contact contact resistance, arc energy and the amount of hydrocarbon ions ($C_2H_3^+$) on the contact surfaces. As a result, while, with the relay of ①, activation was found after one thousand opening and closing operations, with the relay of ②, activation was not found until after twenty thousand opening and closing operations, and further with the relay of ③, no activation was found even after one million opening and closing operations.

For the relay of ①, formic acid of 5 Torr was additionally filled after the activation. The result was that arc energy was reduced to its initial level by 500 opening and closing operations since then, and thereafter, no activation was found even after one million opening and closing operations. It is to be noted that, by experiments in which formic acid was used, a contact activation suppressing effect described above was confirmed within the range of formic acid concentration from 0.01 to 10 Torr. Further, no disadvantage by corrosion, deterioration or the like of the internal components by formic acid was confirmed then.

Having now fully described the invention, it will be apparent to one of ordinary skill in the art that many changes and modifications can be made thereto without departing from the spirit and scope of the invention as set forth herein.

What is claimed is:

1. A switching apparatus, comprising:

an enclosed case;

an electric contact accommodated in said enclosed case; and microcapsules placed in an internal space of said enclosed case, said microcapsules containing an organic acid or organic acid precursor from which organic acid is formed as time passes; wherein the organic acid or organic acid precursor is capable of escaping from said microcapsules, and the organic acid or the organic acid formed from the organic acid precursor is capable of vaporizing in said enclosed case and oxidizing organic compounds which are produced on or in the proximity of a surface of said contact, without forming a film on the surface of said contact, wherein activation of the surface of said contact is suppressed.

2. A switching apparatus, comprising:

an enclosed case;

an electric contact accommodated in said enclosed case; and an organic acid or organic acid precursor from which organic acid is formed as time passes held on said enclosed case or on an internal part of said enclosed case, other than said electric parts; wherein the organic acid or organic acid precursor is capable of escaping from being held on said enclosed case or internal part and vaporizing in said enclosed case and wherein the organic acid or the organic acid formed from the organic acid precursor is capable of oxidizing organic compounds which are produced on or in the proximity of a surface of said contact, without forming a film on the surface of said contact, wherein activation of the surface of said contact is suppressed.

3. A switching apparatus, comprising:

an enclosed case;

an electric contact accommodated in said enclosed case; and an organic acid or organic acid precursor from which organic acid is formed as time passes located in said enclosed case; wherein the organic acid or organic acid precursor is capable of vaporizing in said enclosed case and wherein the organic acid or the organic acid formed from the organic acid precursor is capable of oxidizing organic compounds which are produced on or in the proximity of a surface of said contact, without forming a film on the surface of said contact, wherein activation of the surface of said contact is suppressed.

4. A switching apparatus as claimed in claim 1, 2 or 3, wherein said organic acid or organic acid precursor comprises a carboxyl group or a precursor of an organic acid having a carboxyl group.

5. A switching apparatus as claimed in claim 1, 2 or 3, wherein said organic acid or organic acid precursor comprises formic acid or a formic acid precursor.

6. A method of suppressing activation of an electric contact accommodated in an enclosed case of a switching apparatus, comprising the step of:

placing microcapsules comprising an organic acid or organic acid precursor from which organic acid is formed as time passes into an internal space of said enclosed case such that organic compounds which are produced on or in the proximity of a surface of said contact are oxidized by the organic acid or the organic acid formed by said organic acid precursor which escapes from said microcapsules and vaporizes in said enclosed case, without forming a film on the surface of said contact, wherein activation of the surface of said contact is suppressed.

7. A method of suppressing activation of an electric contact accommodated in an enclosed case of a switching apparatus, comprising the step of:

holding organic acid or organic acid precursor from which organic acid is formed as time passes on said enclosed case or on an internal part of said enclosed case, other than said electric contact, such that organic compounds which are produced on or in the proximity of a surface of said contact are oxidized by the organic acid or the organic acid formed by said organic acid precursor which escapes from the held condition, vaporizes and floats in said enclosed case, without forming a film on the surface of said contact, wherein activation of the surface of said contact is suppressed.

8. A method of suppressing activation of an electric contact accommodated in an enclosed case of a switching apparatus, comprising the step of:

filling an organic acid or organic acid precursor from which organic acid is formed as time passes into said enclosed case such that organic compounds which are produced on or in the proximity of a surface of said contact are oxidized by the organic acid or the organic acid formed by said organic acid precursor which vaporizes in said enclosed case, without forming a film on the surface of said contact, wherein activation of the surface of said contact is suppressed.

9. A method of suppressing activation of an electric contact of a switching apparatus as claimed in claim 6, 7 or 8, wherein said organic acid or organic acid precursor comprises a carboxyl group or a precursor of an organic acid having a carboxyl group.

10. A method of suppressing activation of an electric contact of a switching apparatus as claimed in claim 6, 7 or 8, wherein said organic acid or organic acid precursor comprises formic acid or a formic acid precursor.

11. A method of suppressing activation of an electric contact of a switching apparatus as claimed in claim 6, 7, or 8, further comprising the step of filling oxygen in said enclosed case.

12. A method of suppressing activation of an electric contact of a switching apparatus as claimed in claim 6, 7, or 8, wherein said electric contact contains silver and the oxidation by the organic acid upon the organic substance is promoted by a catalytic action of the silver.

13. A switching apparatus, comprising:

an enclosed case;

an electric contact accommodated in said enclosed case; and microcapsules placed in an internal space of said enclosed case, said microcapsules containing an organic acid or organic acid precursor from which organic acid is formed as time passes.

14. A switching apparatus, comprising:

an enclosed case;

an electric contact accommodated in said enclosed case; and an organic acid or organic acid precursor from which organic acid is formed as time passes held on said enclosed case or on an internal part of said enclosed case, other than said electric contact.

15. A switching apparatus, comprising:

an enclosed case;

an electric contact accommodated in said enclosed case; and an organic acid or organic acid precursor from which organic acid is formed as time passes located in said enclosed case.

16. A switching apparatus as claimed in claim 12, 13 or 14 wherein said organic acid or organic acid precursor comprises a carboxyl group or a precursor of an organic acid having a carboxyl group.

17. A switching apparatus as claimed in claim 12, 13 or 14, wherein said organic acid or organic acid precursor comprises formic acid or a formic acid precursor.

* * * * *